United States Patent [19]

Emerick

[11] Patent Number: 4,901,857

[45] Date of Patent: Feb. 20, 1990

[54] BEVERAGE CAN CADDY

[76] Inventor: Richard W. Emerick, 129 W. Squire Dr., #7, Rochester, N.Y. 14623

[21] Appl. No.: 261,332

[22] Filed: Oct. 24, 1988

[51] Int. Cl.[4] ..... B65D 75/00

[52] U.S. Cl. ..... 206/427; 206/170; 206/201; 294/161; 294/159

[58] Field of Search ..... 206/170, 198, 201, 203, 206/427, 499; 220/8; 294/159, 161, 162, 163

[56] References Cited

U.S. PATENT DOCUMENTS

| | | | |
|---|---|---|---|
| 623,468 | 4/1899 | Forbes | 294/161 |
| 728,018 | 5/1903 | Roudil | 206/201 |
| 774,552 | 11/1904 | Bennett | 206/201 |
| 2,530,231 | 11/1950 | Detweiler | 294/161 |
| 2,813,746 | 11/1957 | Goldsmith et al. | 229/52 DC |
| 4,256,224 | 3/1981 | Hirota | 206/427 |
| 4,542,830 | 9/1985 | Effort | 211/49.1 |
| 4,542,930 | 9/1985 | Adams | 206/427 |
| 4,565,401 | 1/1986 | Young, Jr. | 294/159 |
| 4,789,062 | 12/1988 | Walsh | 206/427 |

FOREIGN PATENT DOCUMENTS

| | | | |
|---|---|---|---|
| 762980 | 2/1934 | France | 294/159 |
| 1323069 | 2/1963 | France | 294/159 |

*Primary Examiner*—David T. Fidei
*Attorney, Agent, or Firm*—Howard J. Greenwald

[57] ABSTRACT

A collapsible storage rack for holding beverage cans is described. The rack contains a top cover and a bottom cover, both of which are slidably attached to the rack. When the top cover is in its open position, beverage cans can be loaded into the rack. When the bottom cover is in its open position, beverage cans can be discharged from the rack. When both covers are in their closed positions, any beverage cans therein are securely retained in the rack and may be transported in the rack.

The storage rack contains frame members which are connected to each other in such a manner that the height of the rack can be varied.

20 Claims, 9 Drawing Sheets

BEVERAGE CAN CADDY

FIELD OF THE INVENTION

A collapsible storage rack for beverage cans is described.

BACKGROUND OF THE INVENTION

Many States have returnable beverage container laws which require the payment of a deposit on cans, such as beverage cans. Some of these laws provide that distributors may require retail stores to sort beverage containers brought to them for redemption.

Because of such laws, consumers typically bring in a random, unsorted collection of cans to a retailer in a bag or box.

U.S. Pat. No. 4,542,830 provided a storage rack for beverage cans which was readily easy to use, which faciliated the sorting of the cans by the consumer, and which was disposable. However, the rack of this patent did not provide for the easy discharge of the beverage cans from the rack into the retailer's collection bin. Furthermore, the rack of this patent did not appear to be reusable many times.

It is an object of this invention to provide a storage rack for beverage can which facilitates both the storing and the sorting of beverage cans by a consumer.

It is another object of this invention to provide a storage rack for beverage cans which facilitates an identification of the number and type of cans in the rack.

It is yet another object of this invention to provide a storage rack whose contents can readily be discharged into a retailer's collection bin.

It is another object of this invention to provide a storage rack which, after beverage cans have been discharged from it, can be compressed into a smaller shape.

SUMMARY OF THE INVENTION

In accordance with this invention, there is provided an extensible and collapsible storage rack for beverage cans comprised of a top movable frame member, a top cover slidably attached to said top movable frame member, a bottom movable frame member, a bottom cover slidably attached to said bottom movable frame member, means for movably connecting said top frame member with said bottom frame member, and means for limiting the movement of said to frame member and said bottom frame member.

Each of said top frame member and said bottom frame members is comprised of a front wall, a back wall, and side walls. The top frame member comprises a top wall comprised of a multiplicity of orifices, and said bottom frame member comprises a bottom wall comprised of a multiplicity of orifices.

The said means for movably connecting said top frame member with said bottom frame is extensible and collapsible, the top of said means is connected to said top wall of the to frame member, and the bottom of said means is connected to said bottom wall of the bottom frame member.

The means for limiting the movement of said top frame member and said bottom frame member is attached to said means for movably connecting said top frame member to said bottom frame member.

DESCRIPTION OF THE DRAWINGS.

The present invention will be more fully understood by reference to the following detailed description thereof, when read in conjunction with the attached drawings, wherein like reference numerals refer to like elements and wherein:

FIG. 13 illustrates another embodiment of the invention; and

DESCRIPTION OF THE PREFERRED EMBODIMENTS

Figure 1:
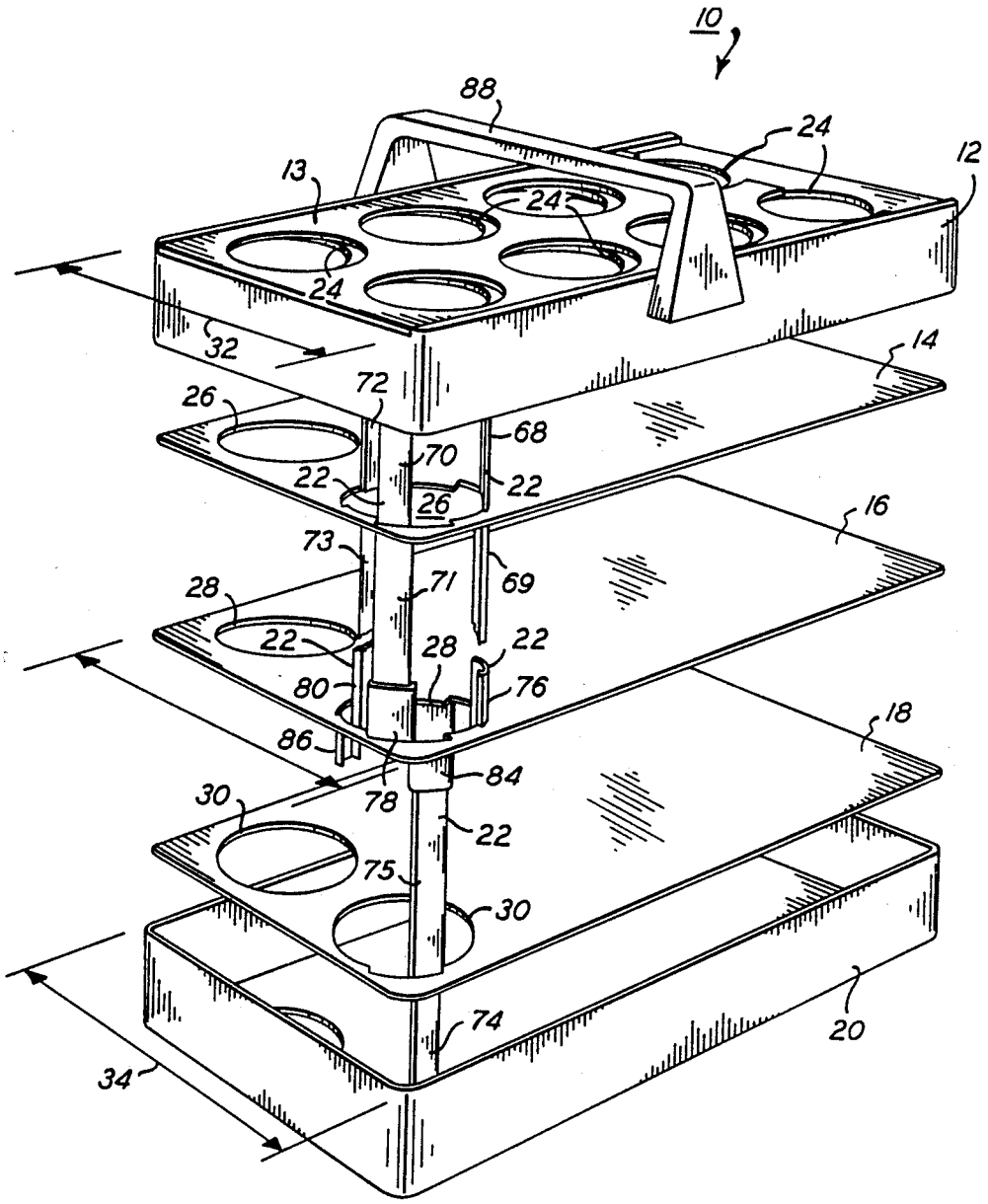
FIG. 1 is a perspective view, partially broken away, of one of the embodiments of this invention.

FIG. 1 is a partial perspective view of one embodiment of applicant's collapsible can caddy in which, for the sake of simplification, only one tubular column is illustrated.

Referring to FIG. 1, the collapsible can caddy 10 comprises movable frame members attached to each other in such a manner that the caddy can alternately be expanded to full height and thereafter contracted. Caddy 10 is preferably comprised of top enclosure 12, top cover 13, center sections 14, 16, and 18, bottom enclosure 20, bottom cover (not shown), and means 22 for connecting top enclosure 12 with bottom enclosure 20.

In the embodiment illustrated in FIG. 1, top enclosure 12 is comprised of a multiplicity of substantially circular openings 24, each one of which is designed to receive a multiplicity of beverage cans. The diameter of the openings 24 is from about 5 to about 50 percent larger than the diameter of the cans and, preferably, is from about 5 to about 30 percent larger than the diameter of the can. In one preferred embodiment, openings 24 are from about 2.5 to about 4.0 inches in diameter and, more preferably, from about 3.0 to about 3.5 inches the diameter.

Each of openings 24 communicates with a similar openings 26 in center section 14, a similar opening 28 in center section 16, and a similar opening 30 in center section 18, and similar openings 31 in bottom enclosure 20. Thus, each set of openings 24, 26, and 28, and 30, together with the comparable opening in bottom enclosure 20, defines a channel for the receipt of the beverage cans. Inasmuch as each beverage can is usually from about 4.5 to about 6.0 inches high, several cans can be stacked in each such channel.

Referring again to FIG. 1, only one such channel is illustrated for the sake of simplicity of illustration. It is to be understood, however, that for each of the openings 24 in top enclosure 12, a channel is formed from corresponding openings 26, 28, and 30 in center sections 14, 16, and 18 as well as a corresponding opening 31 in bottom enclosure 20. Thus, in the embodiment illustrated in FIG. 1, eight separate channels are defined by eight sets of openings 24, each communicating with its own set of openings 26, 28, 30, and 31.

The diameters of openings 24, 26, 28, 30, and 31 can either be the same or different. These openings may define a channel which decreases in diameter, they may define a channel with substantially constant diameter, or they may define a channel with increasing diameter. In general, where the channel defined by the openings either increases or decreases in diameter, the diameter of the top opening is from about 1 to about 25 percent different from the diameter of the bottom opening.

In one preferred embodiment, the diameter of the opening 30 in center section 18 is from about 1 to about 25 percent larger than the diameter of opening 28 in center section 16, the diameter of opening 28 is from about 1 to about 25 percent larger than the diameter of opening 26 in center section 14, the diameter of opening 26 is from about 1 to about 25 percent larger than the diameter of opening 24 in top enclosure 12, and the diameter of opening 30 is from about 4 to about 25 percent larger than the diameter of opening 24. However, each of openings 24, 26, 28, and 30 are from about 2.5 to about 4.0 inches in diameter. It is preferred that opening 31 have a diameter which is from about 4 to about 12 percent larger than the diamter of opening 24, and each of openings 24, 26, 28, 30, and 31 have a diameter of from about 3.0 to about 3.5 inches.

In another embodiment, not shown, the diameter of each of openings 24, 26, 28, 30, and 31 are substantially identical.

In one preferred embodiment, illustrated in FIG. 1, there are two openings 24 in the width 32 of top enclosure 12, and there are two corresponding openings in the widths of center portions 14, 16, 18 and bottom enclosure 20. In this preferred embodiment, the width of the can caddy is said to be two openings.

It is preferred that the width 32 of top enclosure 12 be from about 210 percent to 300 percent of the diameter of opening 24; and it is preferred that the width 32 of top enclosure 12 be from about 250 to about 300 percent of the diameter of opening 24. In one preferred embodiment, width 32 if from about 7.0 to about 9.0 inches and, more preferably, from about 7.5 to about 8.5 inches.

In this preferred embodiment, the width 34 of bottom enclosure 20 is substantially identical to the width 32 of top enclosure 12, being from about 97 to about 105 percent of such width. The width 34 is also from about 210 to about 300 perecent of the diameter of the opening (not shown) in top enclosure 20 which communicates with openings 31, 30, 28, 26, and 24.

Each of the center sections 14, 16, and 18 will have a width which is from about 1 to about 20 percent smaller than width 32 and/or width 34.

In the embodiment illustrated in FIG. 1, the length of top enclosure 12 is from about 415 to about 600 percent of the diameter of opening 24, and the length of bottom enclosure 20 is substantially identical to the length of top enclosure 12, being from about 95 to about 100 percent of such length. However, the lengths of center sections 14, 16, and 18 are from about 1 to about 25 percent less than the length of either top enclosure 12 and/or bottom enclosure 20. I is preferred that the lengths of each of these sections be from about 11.1 to about 18 inches.

Figure 4:
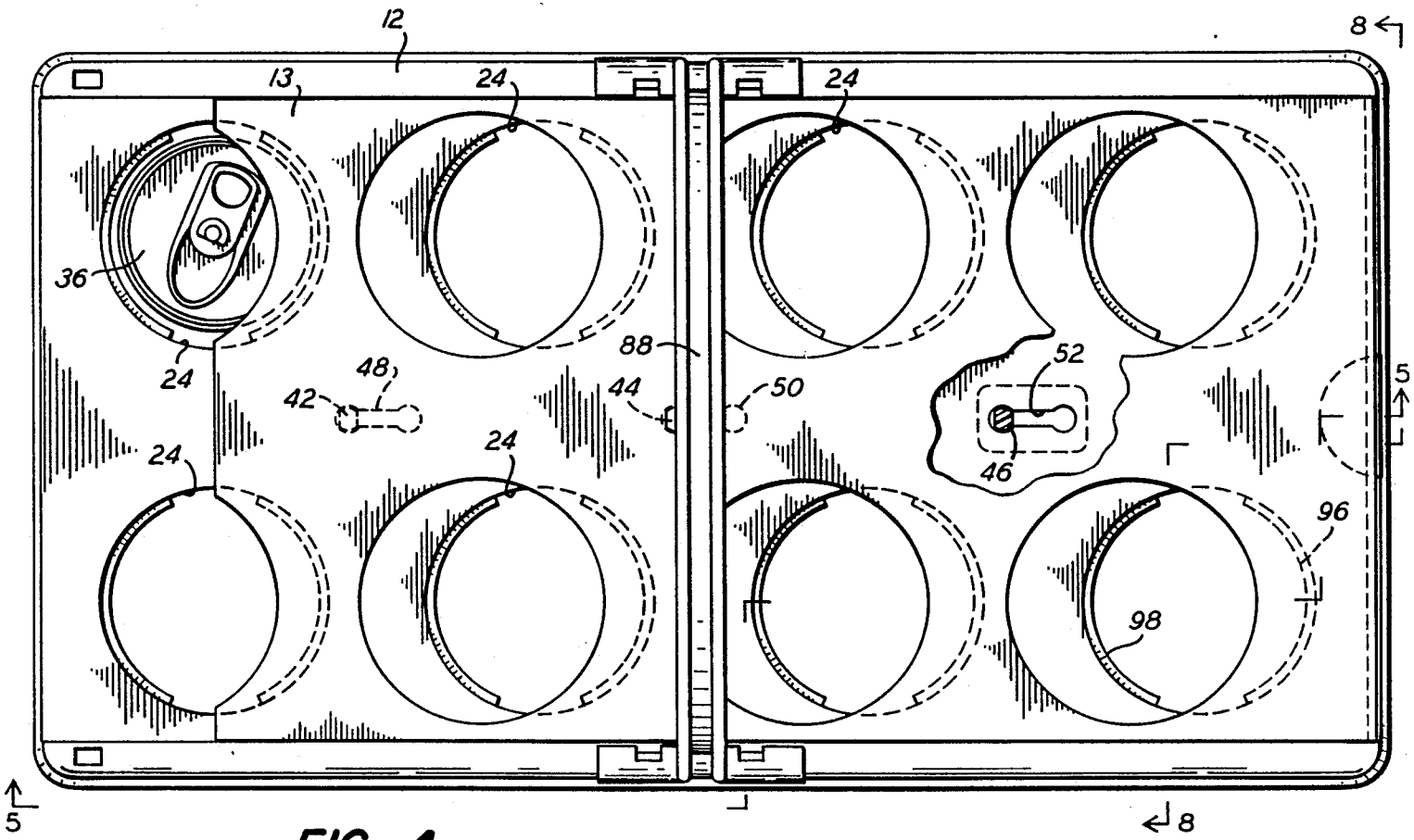
FIG. 4 is a top view of one embodiment and illusrates the top cover.
Figure 5:
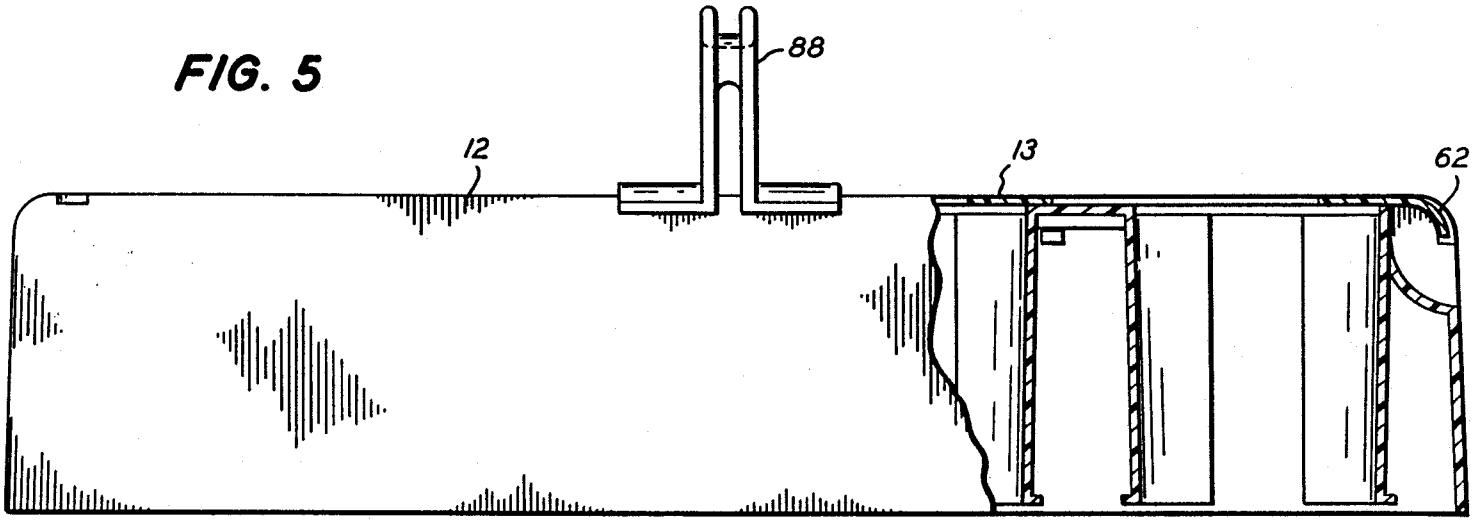
FIG. 5 is a side view of the top enclosure of one embodiment of the invention with a connected top frame member.

Referring again to FIG. 1, the can caddy of this invention is comprised of top cover 13 which, when it is in the closed position, prevents cans which are in the channels comprised of openings 24 from escaping from such channels. In the embodiment illustrated in FIG. 1, top cover 13 is in the open position. FIG. 4 illustrates a preferred embodiment of top cover 13 in its closed position.

Referring to FIG. 4, openings 24 are shown partially covered by cover 13. Thus, for example, a portion of beverage can 36 is partially blanketed by cover 13 so that the the portion of the can indicated by dotted lines 38 will be in contact with the cover when can caddy 10 is turned upside down or tilted. Cover 13 performs a similar function for each of openings 24 when it is in its closed position.

Cover 24 is slidably attached to the top of top enclosure 12 so that it may be slid from its open position (illustrated in FIG. 1) to its closed positon (illustrated in FIG. 4). Any means known to those skilled in the art for slidably attaching cover 13 to top enclosure 12 and for sliding cover 13 may be used.

Figure 6:
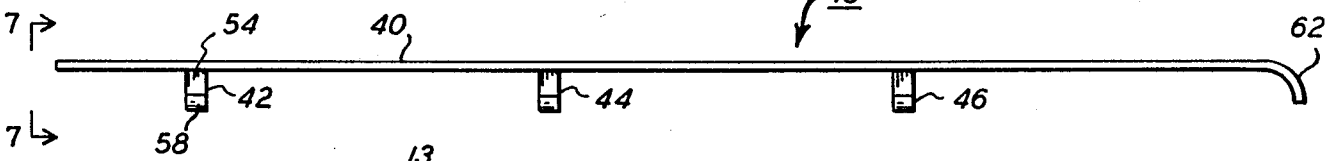
FIG. 6 is a side view of one of the covers of the invention.

By way of illustration and not limitation, one embodiment of cover 13 is illustrated in FIG. 6. In this embodiment, cover 13, shown in cross-section, is comprised of top 40 and guides 42, 44, and 46. Each of guides 42, 44, and 46 fits into slots 48, 50, and 52, respectively, over top enclosure 12 and can slide from the proximal to the distal portion of such slot. The bottoms of guides 42, 44, and 46 can be secured in the slot by means well known to those skilled in the art. Thus, for example, one can use a snap washer, stud pins, keyseats, lock washers, and the like. Thus, for example, one can construct guides 42, 44, and 46 so that, once they are inserted into the slots, they expand to secure themselves within the slot.

Figure 7:
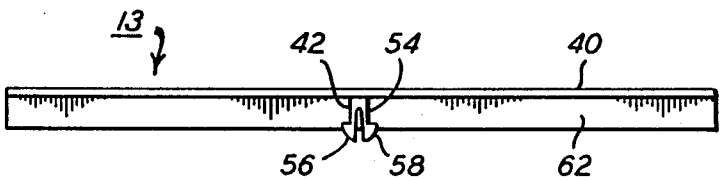
FIG. 7 illustrates how the top cover of the invention is secured in the top or bottom enclosure of one embodiment of this invention.
Figure 8:
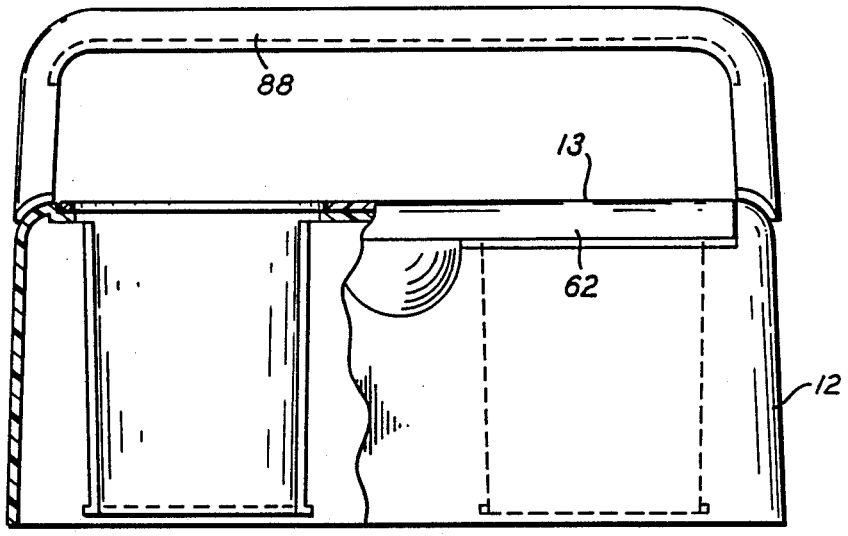
FIG. 8 is an end view of one embodiment of the invention.

Referring to FIG. 7, guide 42 is used to secure cover 13 to top enclosure 12 through slot 48. In this embodiment, the guide is comprised of two tines, 56 and 58, which, after the guide 42 is inserted throught the slot, expand, contact the underside 60 of top enclosure 12, and secures guide 42 to underside 60. Guide 42 is still free to move within slot 48, but it will not fall out of said slot when the unit is tilted or inverted.

Referring again to FIG. 6, cover 13 can be slid lengthwise to cover and/or uncover a portion of openings 24. Thus, e.g., one may push or pull lip 62 to effect movement of the cover 13.

It is preferred that the can caddy of this invention be comprised of both top cover 13 (which is slidably attached to top enclosure 12) and botton cover 64, which is slidably attached to bottom enclosure 20. Thus, referring to FIG. 3, top cover 13 can be slid back and forth by means of lip 62; and bottom cover 64 can be slid back and forth by means of lip 66.

It is preferred that both top cover 13 and bottom cover 64 be substantially identical. In one embodiment, however, top cover 13 and bottom cover 64 are different.

The can caddy of this invention is comprised of means 22 for connecting top enclosure 12 to bottom enclosure 20. It should be recognized that, although three center sections are illustrated in FIG. 1, more of fewer center sections may be used. Furthermore, in some embodiments, no such center sections are required.

In general, the means 22 for connecting top enclosure 12 to cneter sections 14, 16, and 18 and bottom enclosure 20 will have certain features. On feature is that it will be so dimensioned as to receive a beverage can; it thus preferably will have a partially circular cross-section, although any other cross sections which will receive the can also may be used (such as, e.g., partially hexagonal cross-sections, square cross-sections, and the like). It will be open so that the beverage can partially enclosed by the means will be visible; the term open refers to a surface with discrete ends.

One means 22 for connecting the top and bottom enclosures is illustrated in FIG. 1, wherein an open, circular column is defined by such means 22. In the embodiment illustrated in this FIG. 1, projections 68, 70, and 72 are attached to the underside (not shown) of top enclosure 12. Projections 68, 70, and 72 telescope into projections 69, 71, and 73 in center section 14. Similar projections extend from the top side of bottom enclosure 20. Although only projection 74 is shown for the sake of simplicity, it is preferred that at least three such projections extend from the top side of bottom enclosure 20 and telescope into projection 22 of center section 18.

The projections are so disposed on the bottom side of top enclosure 12 and the top side of bottom enclosure 20 so that, when the can caddy is collapsed inwardly, the projections extending downwardly from the bottom of the top enclosure do not prevent the upward movement of the projections extending upwardly from the top of the bottom enclosure. Thus, by way of illustration, when projection 70 is extended through opening 28 it does not prevent the upward movement of projection 74 through such hole.

Each of the upwardly-extending and downwardly extending projections is preferably captured by a guide which insures that it will travel in a specified track and will not interfere with projections travelling the opposite direction; thus, in the emdobidment illustrated in FIG. 1, the projections slide past each other in the guides in center section 16 when the can caddy is being collapsed. Thus, in one preferred embodiment, guides 76, 78, and 80 are attached to and extend from the top side of center section 16, and they insure that projections 69, 71, and 73, respectively, travel in specified path. Similary, like guides 84 and 86 (and another guide, not shown) insure that the projections from bottom unit 20 travel in a specified path. Some of the projections from bottom unit 20 and some of the guides on the underside of center section 16 have been omitted from FIG. 1 for the sake of simplicity. However, it is to be understood that is is preferred that three proejctions extend from the top of bottom enclosure 20 and be captured by three guides attached to and extending downwardly from the bottom of center section 16.

In one preferred embodiment, not shown, projections 68, 70, 72, and 74 (and other projections, not shown) are equipped with means for limiting the the outward movement of top enclosure 12 and bottom enclosure 20. In one embodiment, said projections are equipped with inwarldly extending or outwardly extending detents so that, after each of the projections has moved iwthin its guide for a specified distance, it can move not further.

In the operation of the can caddy described in FIG. 1, the can caddy is extended to its open position, bottom cover 64 is closed, and a multiplicity of cans may be inserted into opening 24. The first can will travel downwardly through opening 24, through opening 26, through opening 28, through opening 30, and through the opening in the bottom enclosure 24 until it contacts the bottom cover 64 (not shown), which is in its closed position. The second can will travel downwardly through the opening until it hits the top of the first can. Additional cans may then be inserted through opening 24 until the channel defined by this opening and openings 26, 28, 30, and 31 is full of such cans. At that point, cover 13 may be closed. Alternatively, cover 13 may be allowed to remain open and other cans may be inserted into channels formed by other openings 24, 26, 28, 30, and 31.

Once the can caddy is full of cans, cover 13 may be closed, and the caddy may be transported to a redemption center. The can caddy may be carried by handle 88, which is preferably athed to top enclosure 12.

When the can caddy has reached the redemption center, a visual inispection may be made of the cans in each of the channels to determine their identity (manufacturer) and number. One of the advantages of the design of the can caddy of this invention is that one has physical access to the cans in the channels and may lift and/or turn them while they are in the channel to inspect their deposit markings (usually on the tops of the cans) and/or their brand identification.

Once an inspection has been made of the can in the caddy, the cans may be discharged from the caddy by lifting the caddy over a receiving surface for the cans and pulling bottom cover 64 to its open position. The cans will drop out of the bottom of the caddy substantially simultaneously.

The empty caddy may then be collapsed by pushing the top enclosure 12 and the bottom enclosure 20 together. The projections extending from such enclosure slide in their guides oppoosite the projections from the opposing enclosure, and the unit is collapsed.

Figure 2:
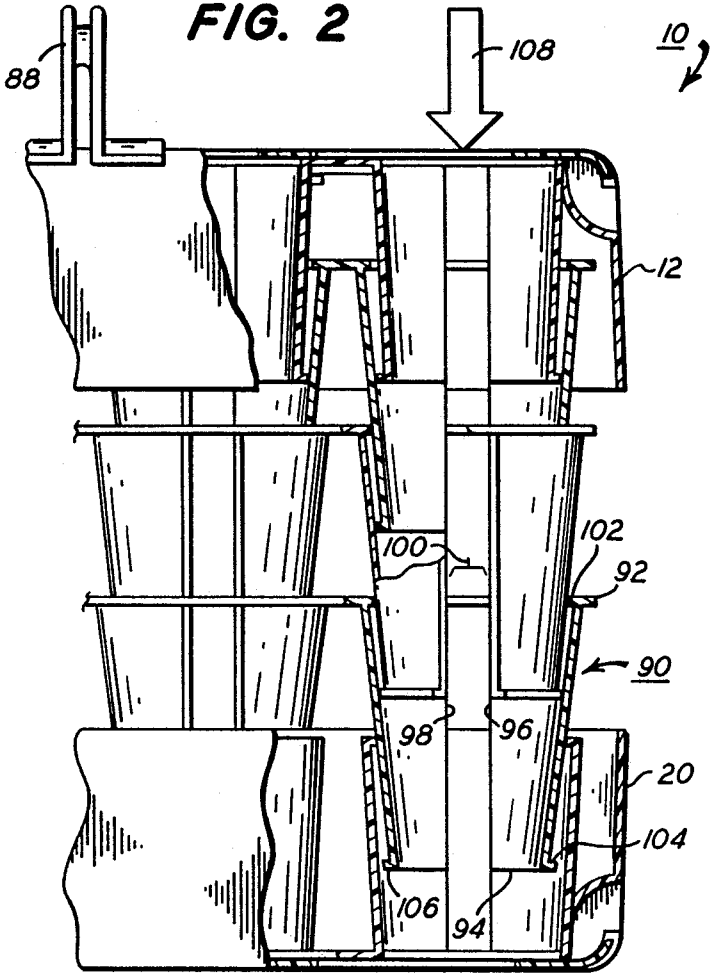

Another means for connecting top enclosure 12 and bottom enclosure 20 is illustrated in FIG. 2. In this embodiment, the connecting means are comprised of a series of slotted devices.

The slotted devices illustrated in FIG. 2 are open. As the term open is used in this specification, it refers to a surface with a top edge, a bottom edge, a left edge, and a right edge wherein: (1) the top edge and the bottom edge do not form a closed surface, edge, and (2) at least 25 percent of the left edge is not connected to the right edge.

Referring to FIG. 2, one such slotted device is identified as 90 and is comprised of top edge 92, bottom edge 94, right edge 96, left edge 98, slot 100, inwardly-extending detent 102, and outwardly-extending detents 104, 105 and 106.

Device 90 preferably has a substantially conical cross-section, with the diamter of its top section being larger than the diameter of its bottom section. However, in other embodiments (not shown), the diameter of the bottom section may be larger than that of the top section, or it may be substantially identical.

Top edge 92 of device 90 is not joined to bottom edge 94 of device 90 to form a closed surface; if such a closed surface were formed, a beverage can could not be accomadated by device 90. Left edge 98 of device 90 is not joined to right edge 96 of device to form a closed surface wherein there is no gap between said edges; it such a closed surface were formed, then one could not see or physically acccess the can within device 90. One can partially join the left edge(s) of device 90 with the right edge(s) of device 90 as long as at least about 25 percent of the left edge is not joined to the right surface. In the embodiment illustrated in FIG. 2, gap 100 extends from the top of device 90 to the bottom of device 90, and zero percent of the left edge of the device is connected to the right edge of the device.

FIG. 2 illustrates a device 90 which is of slotted, substantially conical cross-section. However, any device which will (1) be dimensioned to receive the beverage can, (2) not define a closed surface with its top and bottom edges, and (3) not have more than about 75 percent of its left edge(s) connected to its right edge(s) can be used as device 90. Thus, by way of illustration and not limitation, one may use a slotted, inverted conical cross-section. Thus, one may use a slotted cylindrical cross-section. Thus, one may use a slotted polygonal cross-section whose top diameter may be the same and/or different from its bottom diameter. Thus, one may use a slotted square cross-section. Thus, one may use a device whose left side and right side are partially joined to each other at one or more points as long as enough of the left edge and the right edge are left unjoined so that one can see and access the can in device 90.

In one embodiment, device 90 has one cross-section in one of its portions and a different cross-section in another of its portions.

Device 90 is comprised of means for limiting the movement of top enclosure 12 and bottom enclosure 20. In the embodiment illustrated in FIG. 2, such means comprise inwardly and outwardly-extending detents.

Referring to FIG. 2, the top edge 92 of device 90 contains an inwardly-extedning detent 102 which extends from upper edge 92 of device 90. In the embodiment illustrated in this Figure, the detent 102 extends across only a portion of the top edge 92. In another embodiment, not shown, the detent 102 extends around the entire length of top edge 92. In another embodiment, not shown, not shown, a multiplicity of inwarldy extending detents 102 extend across the length of top edge 92.

Referring again to FIG. 2, the bottom edge 94 of device 90 is comprised of an outwardly-extending detent 104. In the embodiment illustrated in the Figure, detent 104 extends from left side of device 90. As before, more than one detent 104 can be used, and detent(s) 104 can extend across all or only a portion of bottom edge 94.

Device 90 is preferably constructed of a crystalline material which has a degree of springiness and flexiblity such that, when device 90 is compressed such that left edge 98 is moved towards right edge 96, the device tends to spring back to its original configuration once the pressure of compression is removed. Suitable crystalline materials include polypropylene, polyethylene, and the like.

In order to construct means 22, a multiplicity of devices 90 is provided. One device 90 is compressed so that its left edge 98 is moved towards its right edge 96, and the compressed device is then placed within a second device 90. The second device 90 may be similarly compressed and placed within a third device 90; and the like.

Figure 3:
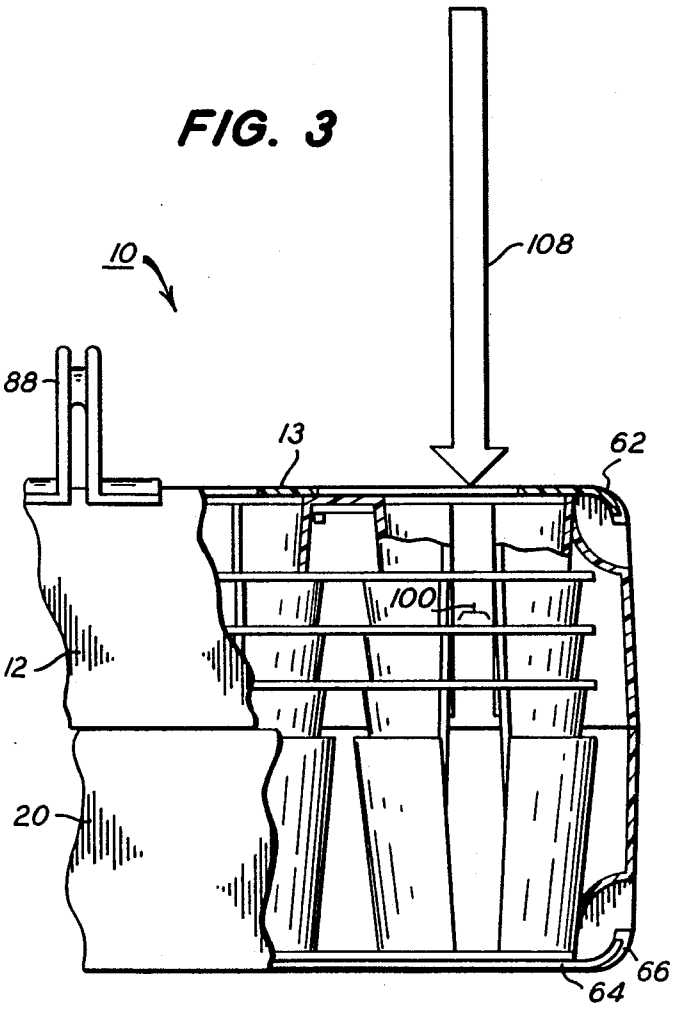
FIGS. 2 and 3 are partial cross-sectional views, showing the open and closed positions, showing one of the embodiments of the invention.

In the embodiments illustrated in FIGS. 2 and 3, five devices 90 comprise means 22. Referring to FIG. 2, pressure is applied in the direction of arrow 108, and top enclosure 12 moves towards bottom enclosure 20. Each device 90 slides in the lower adjacent device 90 in which it is enclosed.

Figure 9:
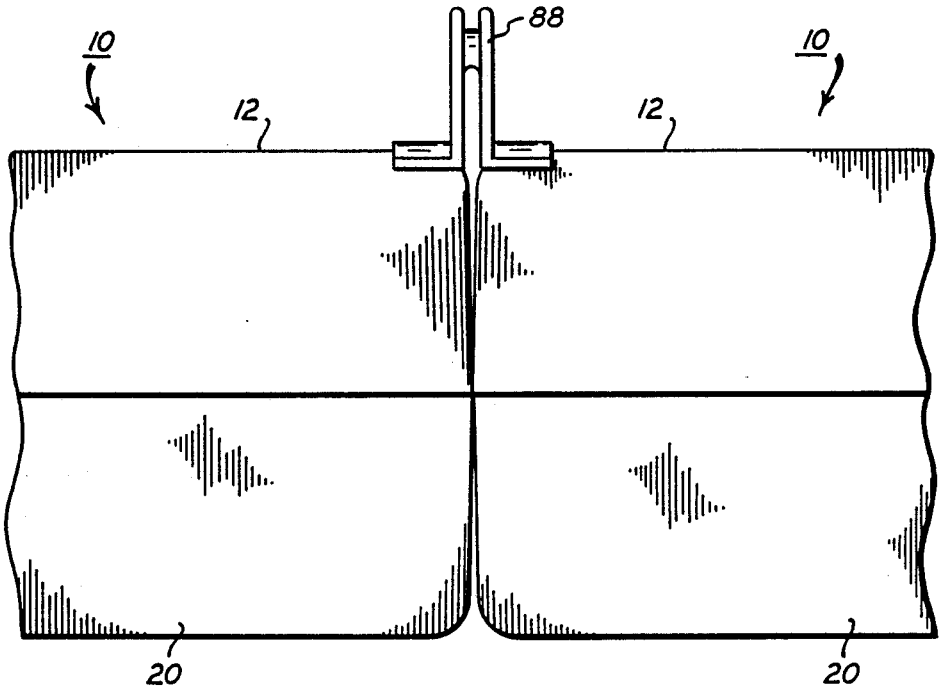
FIG. 9 illustrates an embodiment wherein two beverage can caddies are joined together by handle 88.

FIG. 3 illustrated the can caddy of this invention in the closed position. As is illustrated in this Figure, when the can caddy of this invention is empty and comrpessed, it takes up relatively little space and can be compressed to about 35% of its extended height. FIG. 9, It should be noted that, in both its open and closed positon, slot 100 allows visibility of and access to the beverage cans in the caddy. It also should be noted that detents 102 and 104 limit the movemeent of abutting devices 90. A top device 90 can only extend so far before its outwardly extending detent(s) 104 abut against the inwardly extending detent 102 of the bottom device 90 in which it is enclosed, at which point the motion must cease.

Figure 14:
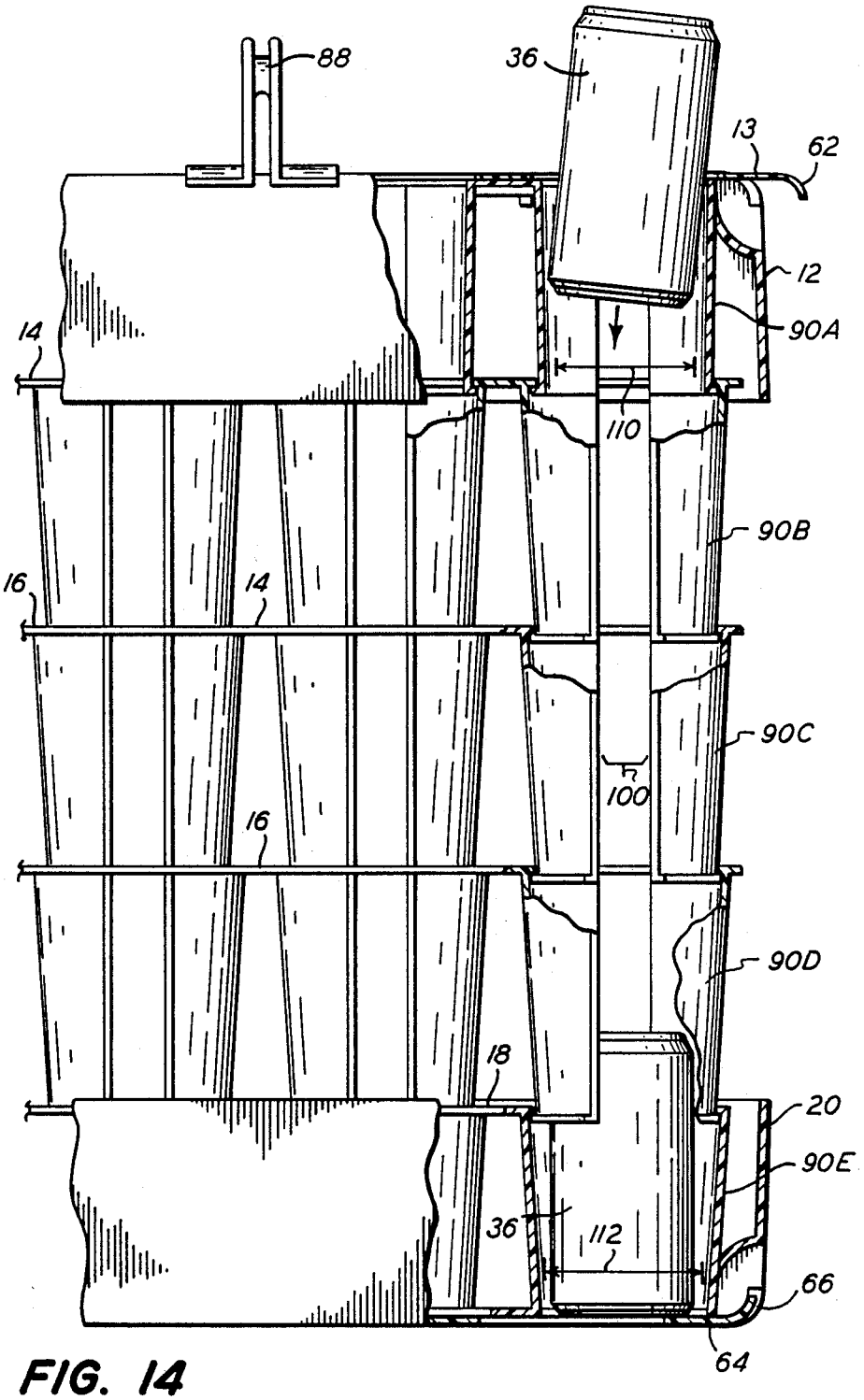
FIG. 14 is a side view, partially cut away, of one of the preferred embodiments of the caddy of this invention.

One embodiment of the slotted cylindrical devices 90 is illustrated in FIG. 14. In this embodiment, a channel is defined by devices 90A, 90B, 90C, 90D, and 90E. This channel has an inverted, funnel-like shape with a several degree draft from top 110 to bottom 112. A slot 100 communicates between top 110 and bottom 112 and allows one to visually identify any beverage can which may be contained in this device. One may prepare such a device by, e.g., providing a dixie-cup, conical type of structure with an open top and a closed bottom, cutting off the bottom of said structure, and cutting a slot from the top to the bottom of such structure.

In another embodiment, not shown, top 110 and bottom 112 of the cylindircal devices 90 have substantially 0 degrees draft, e.g, have substantially the same diameter.

Referring again to FIG. 14, device 90A is connected to top enclosure 12, device 90B is connected to center 14, device 90C is connected to center sction 16, and device 90D is connected to center section 18. In the embodiment illustrated in the Figure, the top of deviced 90A is connected to the bottom surface of enclosure 12 so that, when top enclosure 12 is moved, a corresponding movement is caused in device 90A. One may use means known in the art to effectuate such connection. Thus, by way of illusration and not limiation, one may use male and female snap connectors.

Referring again to FIG. 14, device 90E is connected to bottom enclosure 20 so that, when such bottom enclosure is moved, a corresponding movement is caused in device 90E. Such connection may be made by means identical to or different from the means used to connect device 90A to top enclosure 12.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

Thus, by way of illustration, one may utilize two can caddies with one handle. As is illustrated in FIG. 9, two can caddies 10 can be carried by one handle 88. The can caddies 10 may be joined together by conventional means such as, snap pins (not shown).

Figure 10:
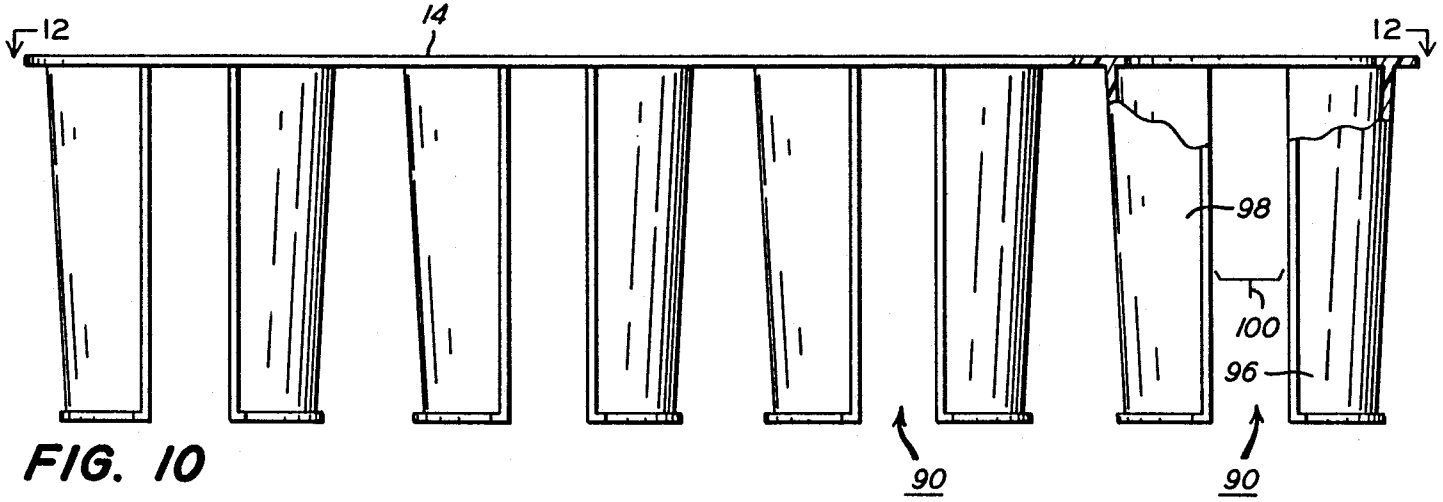
FIGS. 10 and 13 illustrate two different means for connecting the channel members of the center sections in a single plane.
Figure 11:
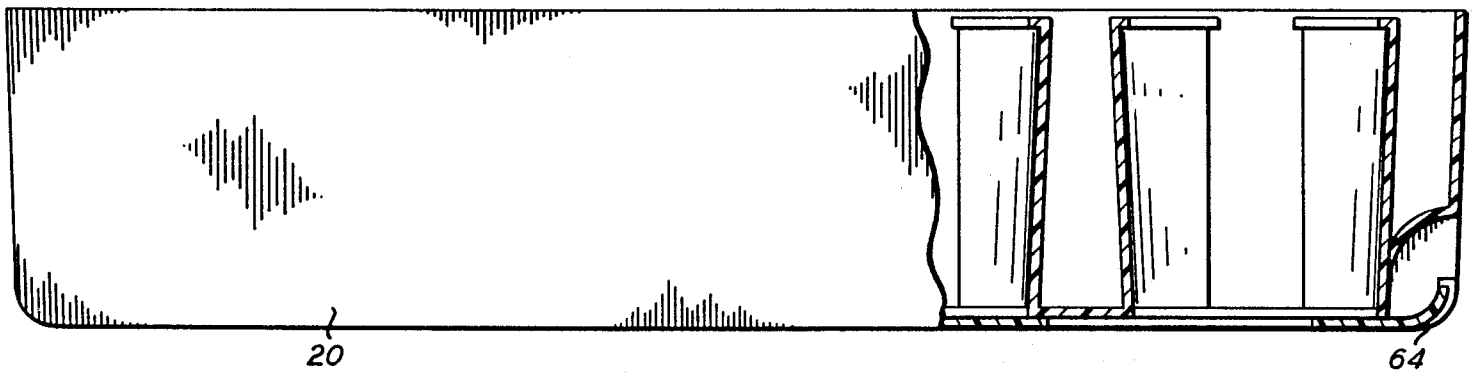
FIG. 11 illustrates a bottom enclosure with a connected bottom frame member.
Figure 12:
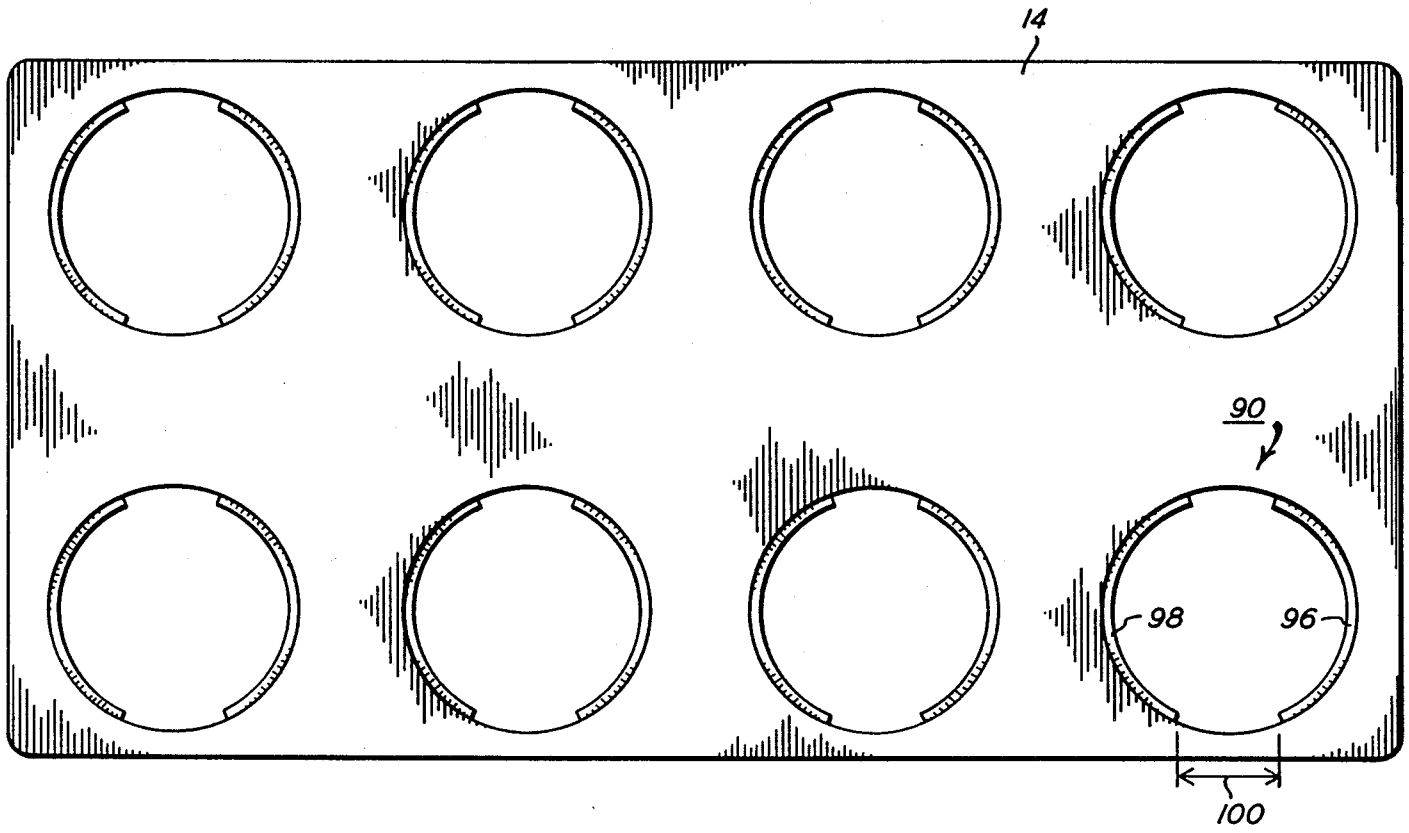
FIG. 12 is a top view of the apparatus of this invention.

Thus, by way of illustration, devices 90A, 90B, 90C, and the like may be attached to center sections 14 and/or 16 and/or 18. Thus, intermediate devices 90A may be attached to center section 14, intermediate devices 90B may be attached to center section 16, and intermediate devices 90C may be attached to center section 18. In this embodiment, all of intermediate devices 90A, e.g., are preferably maintained in one plane by their connection to the center section, and the other devices 90 are similary maintained in fixed spatial relationships. FIG. 10 illusrates this spatial relationship with center section 14 and devices 90A.

Figure 13:
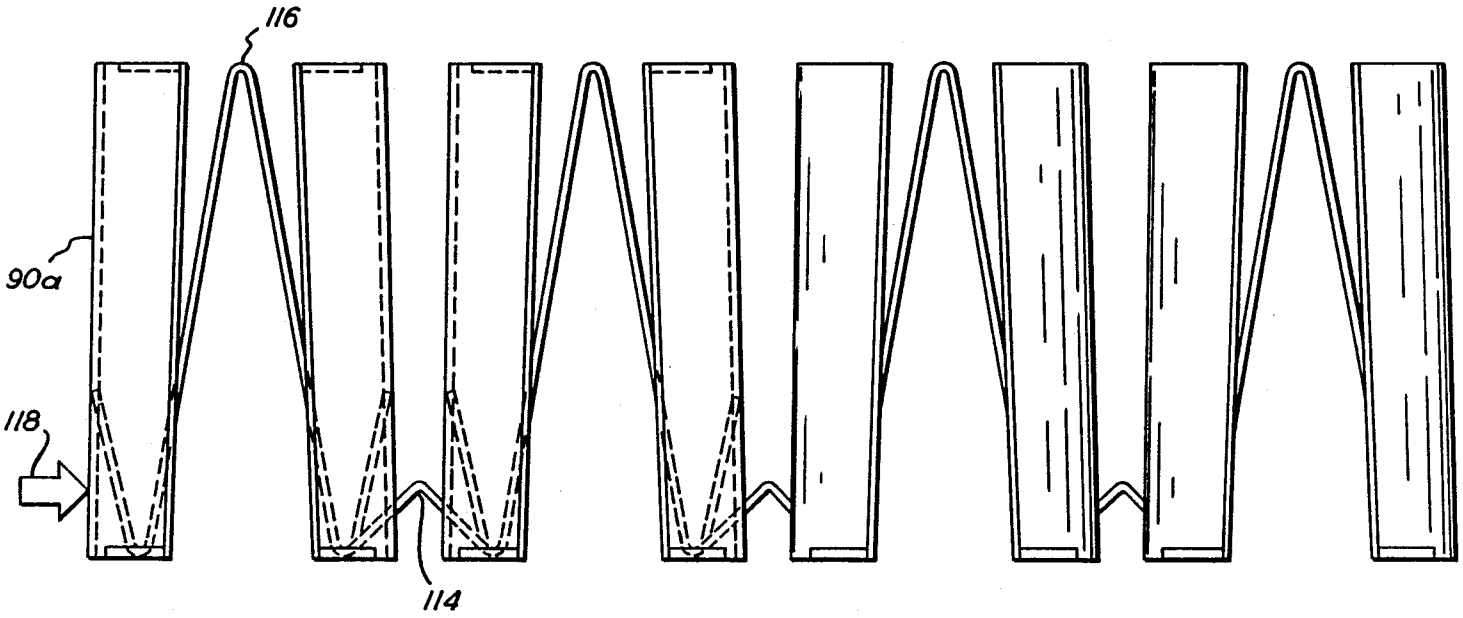

Thus, in another embodiment, devices 90 may be attached to each other by flexible means so that the spatial relationships they have to adjacent devices 90 may be altered by the application of force. Referring to FIG. 13, devices 90A are connected to each other by spring-like material 114 and 116 which abut the interiors of devices 90A. When pressure is applied in the direction of arrow 118, the assembly of devices 90A may be compressed. The embodiment of this figure serves the same function as the embodiment of FIG. 10, providing a center section with depending devices 90A, but it adds the advantages of providing a flexible spatial relationship. In cases where one is concerned with maximizing lateral stability of the can caddy in its extended position, one might choose to utilize the embodiment of FIG. 10. In cases where flexibility is more important, one may utilize the embodiment of FIG. 13.

I claim:

1. A extensible and collapsible storage rack for beverage cans comprised of a top movable frame member, a top cover slidably attached to said top movable frame member, a bottom movable frame member, a bottom cover slidably attached to said bottom movable frame member, means for movably connecting said top frame member with said bottom frame member, and means for limiting the movement of said top frame member and said bottom frame member, wherein:

(a) each of said top frame member and said bottom frame member is comprised of a front wall, a back wall, and side walls;

(b) said top frame member comprises a top wall comprised of a multiplicity of orifices, and said bottom frame member comprises a bottom wall comprised of a multiplicity of orifices;

(c) said means for movably connecting said top frame member with said bottom frame is extensible and collapsible, the top of said means is connected to said top wall of the to frame member, and the bottom of said means is connected to said bottom wall of the bottom frame member; and (d) said means for limiting the movement of said top frame member and said bottom frame member is attached to said means for movably connecting said top frame member to said bottom frame member; and (e) each of said top cover and said bottom cover is comprised of a multiplicity of orifices.

2. The storage rack as recited in claim 1, wherein said rack comprises at least one center section intermediate said top frame member and said bottom frame member, said center section is comprised of a multiplicty of orifices, and said means for movably connecting said top frame member to said bottom frame member also connects said center section to said top frame member and said bottom frame members.

3. The storage rack as recited in claim 2, wherein said rack is comprised of at least two of said center sections; and wherein said means for connecting said top frame member to said bottom frame member is dimensioned to receive a beverage can.

4. The storage rack as recited in claim 3, wherein said rack is comprised of at least three of said center sections.

5. The storage rack as recited in claim 4, wherein each of said orifices is substantially circular.

6. The storage rack as recited in claim 5, wherein each of said orifices has substantially the same diameter.

7. The storage rack as recited in claim 5, wherein the diameter of each of the orifices in said top frame member are substantially ientical.

8. The storage rack as recited in claim 7, wherein the diameter of each of the orifices in said bottom frame member are substantially identical.

9. The storage rack as recited in claim 8, wherein the diameter of the orifices in said bottom frame member is from about 1 to about 25 percent greater than the diameter of the orifices in said top frame member.

10. The storage rack as recited in claim 9, wherein the diameter of the orifices in both the top frame member and the bottom frame member is from about 2.5 to about 4.0 inches.

11. The storage rack as recited in claim 10, wherein the width of said top frame member is from about 210 to about 300 percent of the diameter of the orifices in said top frame member.

12. The storage rack as recited in claim 11, wherein the width of said bottom frame member is from about 97 to about 105 percent of the width of said top frame member.

13. The storage rack as recited in claim 12, wherein the length of said top frame member is from about 415 to about 600 percent of the diameter of the orifices in said top frame member.

14. The storage rack as recited in claim 13, wherein the length of said bottom frame member is from about 95 to about 100 percent of the length of said top frame member.

15. The storage rack as recited in claim 14, wherein the length of each of said center sections is from about 1 to about 25 percent less than the length of said top frame member.

16. The storage rack as recited in claim 15, wherein said means for connecting said top frame member to said bottom frame member is comprised of a slotted opening which extends from the the about top of such means to about the bottom of such means.

17. The storage rack as recited in claim 16, wherein said means for connecting said top frame member to said bottom frame member is comprised of at least two slotted, open devices.

18. The storage rack as recited in claim 17, wherein said means for connecting said top frame member with said bottom frame member is comprised of at least three slotted, open devices.

19. The storage rack as recited in claim 18, wherein each of said slotted, open devices has a substantially conical cross-section.

20. The storage rack as recited in claim 19, wherein each of said slotted, open devices is comprised of an inwardly-extending detent on its top edge.

* * * * *